US005535534A

United States Patent [19]

Li et al.

[11] Patent Number: 5,535,534

[45] Date of Patent: Jul. 16, 1996

[54] BURN PREVENTION SHIELD OF AN IRON

[75] Inventors: Kwan-Tao Li, 9F, No. 19, Lane 64, Tun Hua South Road; Elton Shiou, both of Taipei, Taiwan

[73] Assignee: Kwan-Tao Li, Taipei, Taiwan

[21] Appl. No.: 529,535

[22] Filed: Sep. 18, 1995

[51] Int. Cl.[6] ..... D06F 75/36

[52] U.S. Cl. ..... 38/95

[58] Field of Search ..... 38/75, 89, 95, 38/96, 88, 94; 219/245, 246, 242, 259; 83/DIG. 1, 860

[56] References Cited

U.S. PATENT DOCUMENTS

| | | | |
|---|---|---|---|
| 626,286 | 6/1899 | Miller | 38/95 |
| 2,095,954 | 10/1937 | Beck | 38/89 X |
| 2,149,251 | 3/1939 | Campana | 219/246 X |
| 2,957,257 | 10/1960 | Abbott | 38/89 |
| 4,625,604 | 12/1986 | Handler et al. | 83/DIG. 1 |

*Primary Examiner*—Ismael Izaguirre
*Attorney, Agent, or Firm*—Banner & Allegretti Ltd.

[57] ABSTRACT

A burn prevention device of an iron. The device comprising a shielding element adaptable to cover the heated edge of the heating plate of an iron, and an actuating device to urge the movement of the shielding element to either cover the heated edge or restore it to its original position.

6 Claims, 7 Drawing Sheets

BURN PREVENTION SHIELD OF AN IRON

BACKGROUND OF THE INVENTION

The present invention relates to a burn prevention device of an iron, in particular, to a device including a shielding element, a first and a second displacement member and an actuating means such that the entire edge of the heating plate of the iron is temporarily encapsulated or shielded when the iron is placed vertically with its end base of the iron on a horizontal platform or the like.

There are different types of irons in the market and all these irons have specific features and functions in view of the structure. Some types of irons have improvements on the heating element, and some other types on the steam production, etc., but none of these irons has a burn prevention device to prevent the user from accidental contacts with the hot edge of the heating plate while ironing.

Thus, it is apparent that a new type of iron with burn prevention is desirable in order to prevent the user from contacting the hot edge of the heating plate of the iron. In accordance with the present invention, it is desirable to provide a burn prevention device which can be operated automatically to shield the heated edge of the heating plate of the iron.

SUMMARY OF THE INVENTION

It is therefore an objective of the present invention to provide a burn prevention device for an iron, wherein the entire edge of the heating plate of the iron is encompassed by a shielding element.

It is another objective of the present invention to provide a burn prevention device for an iron, wherein the shielding element is made of heat resistance materials, such as plastics.

It is yet another object of the present invention to provide a burn prevention device for an iron, wherein a first and a second displacement member is respectively mounted onto the first and second lateral edge of the shielding element to automatically depress the burning prevention device to encompass the heated edge of the heating plate of the iron.

It is yet another object of the invention to provide a burn prevention device for an iron, wherein the shielding element is configured to be smoothly fitted onto the entire edge of the heating plate of the iron.

These and other objectives and advantages are achieved by the present invention which provides a burn prevention device which is operated automatically when the iron is held vertically with its end base on a horizontal platform.

BRIEF DESCRIPTION OF THE DRAWINGS

The invention will be more fully appreciated from the following detailed description when the same is considered in connection with the accompanying drawings in which.

DETAILED DESCRIPTION OF THE INVENTION

Figure 1:
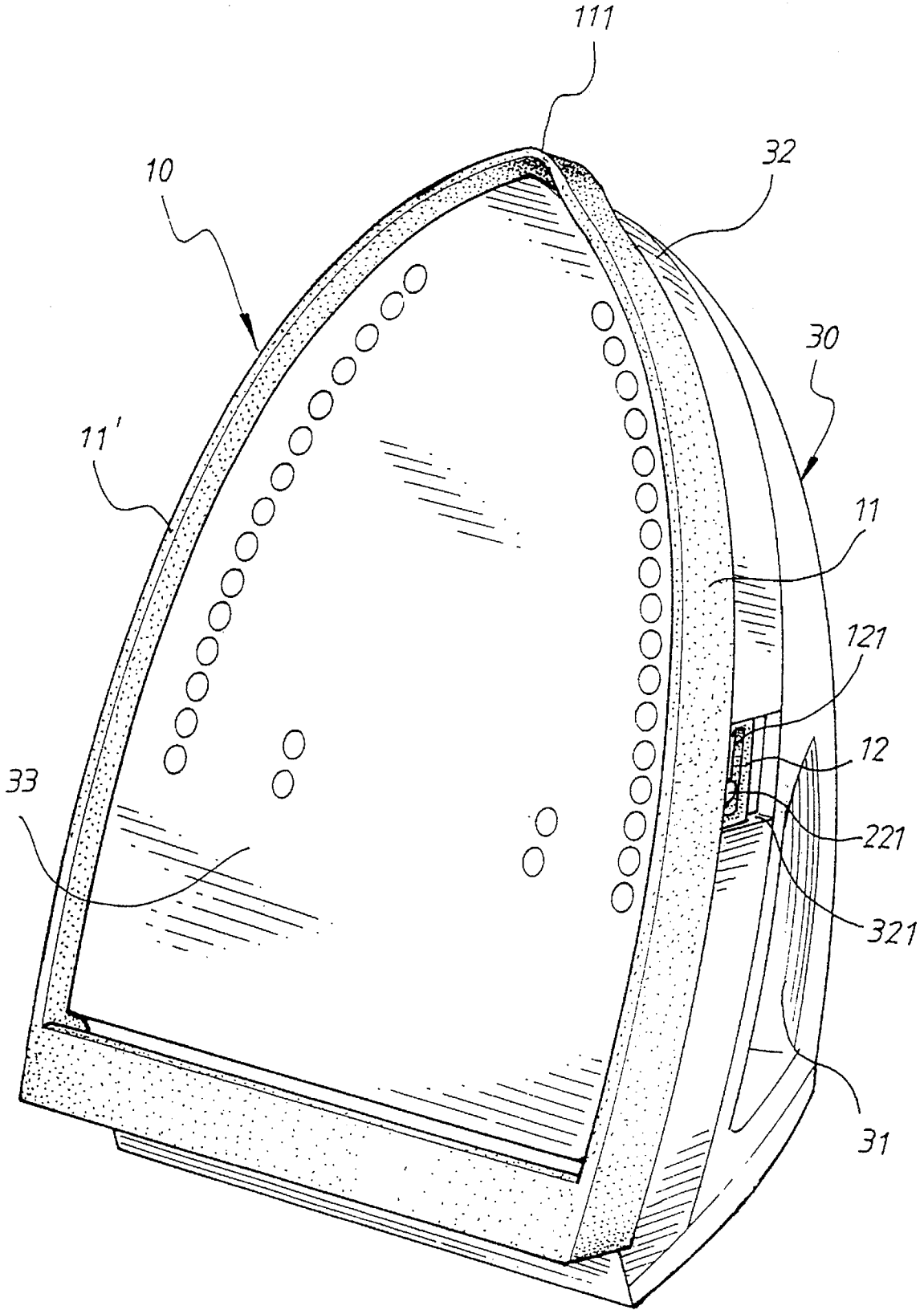
FIG. 1 is a perspective view of the present invention showing the iron encompassed with the shielding element when the iron is placed vertically with its end base on a horizontal platform.
Figure 2:
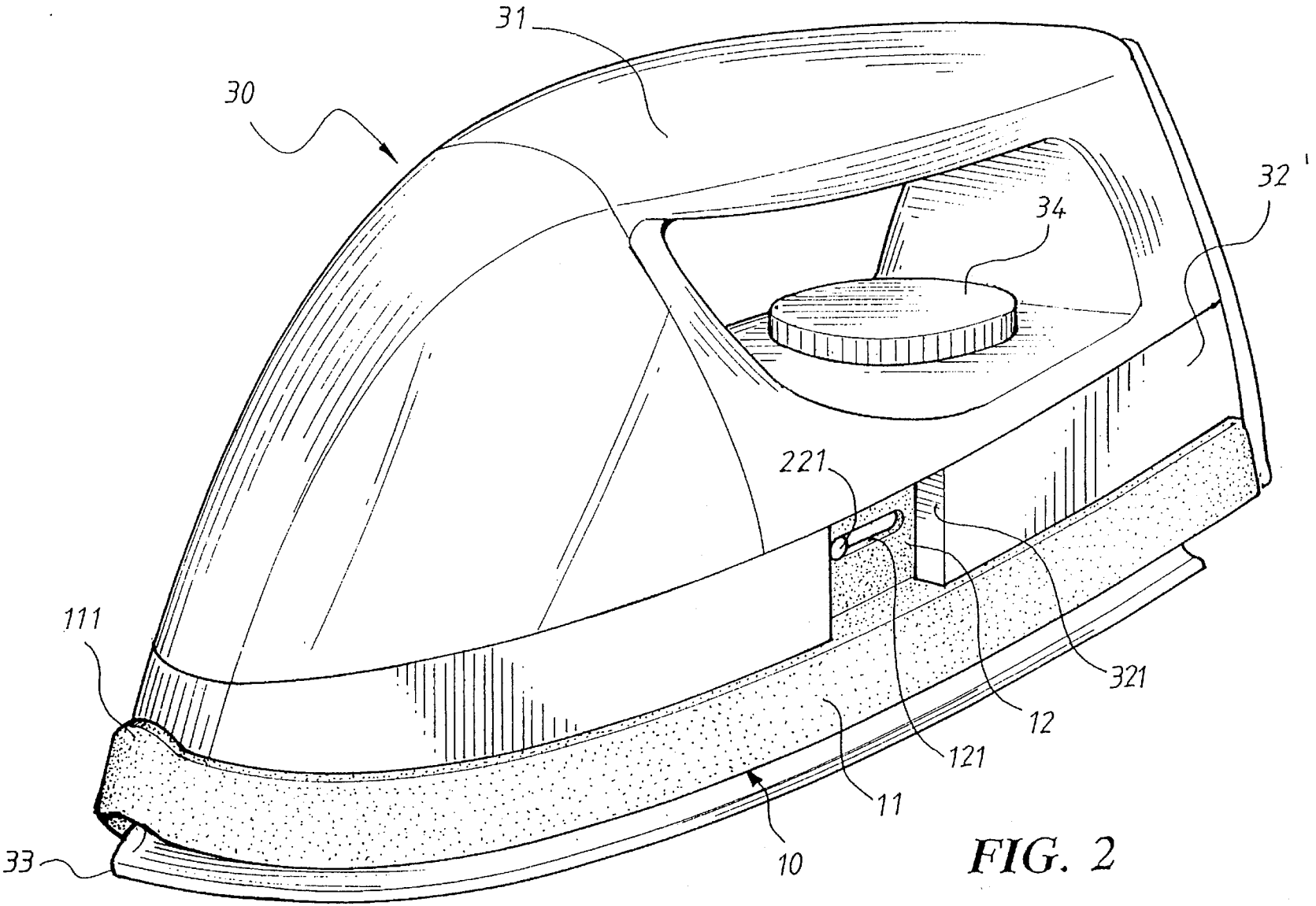
FIG. 2 is a perspective view of the present invention showing the shielding element being retracted to its original position when the iron is in use.
Figure 3:
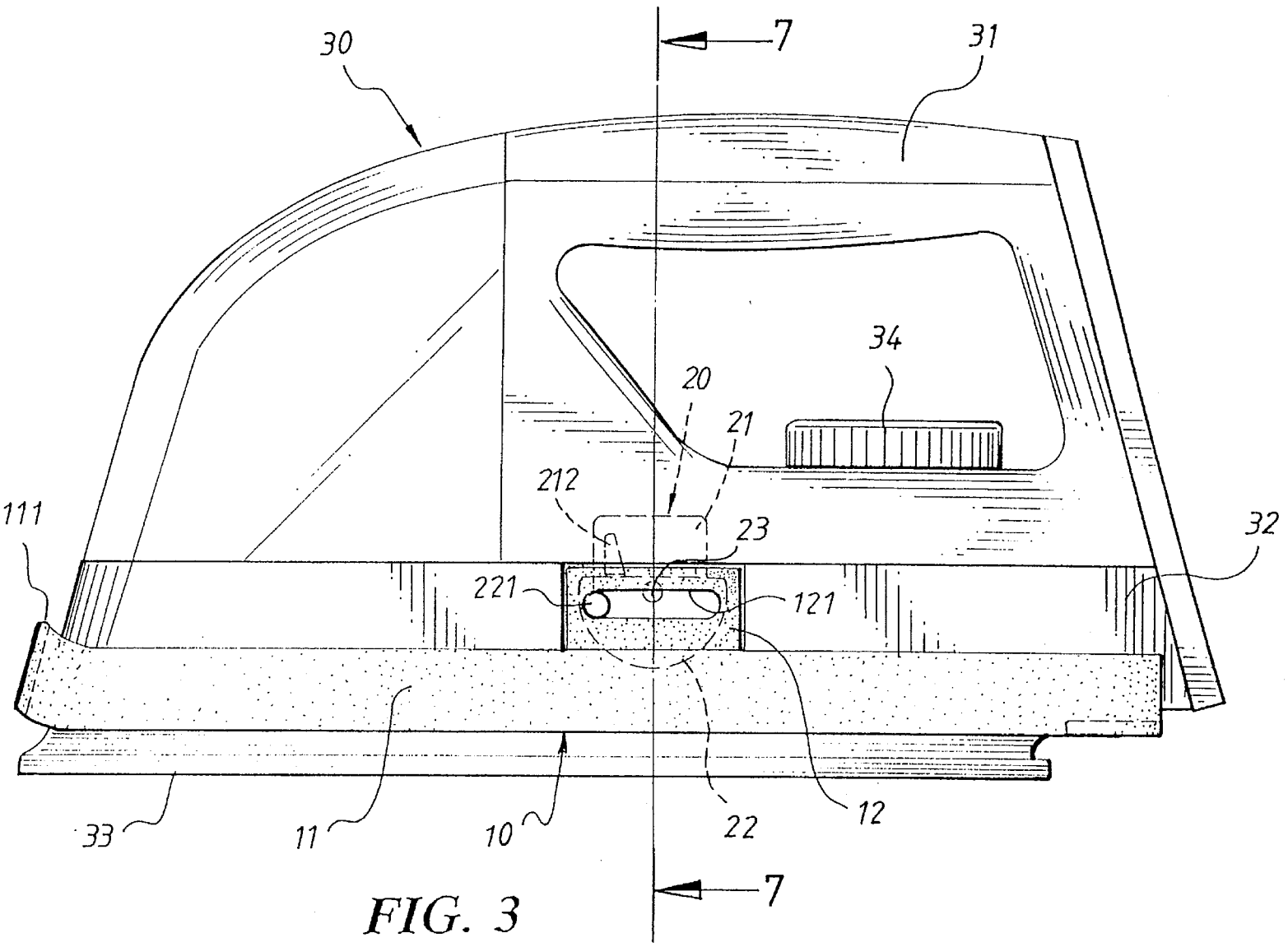
FIG. 3 is an elevational view of the iron being shielded with a burn prevention device; the dotted line indicates the position of the heavy-weighed eccentric block incorporating the first displacement member.
Figure 4:
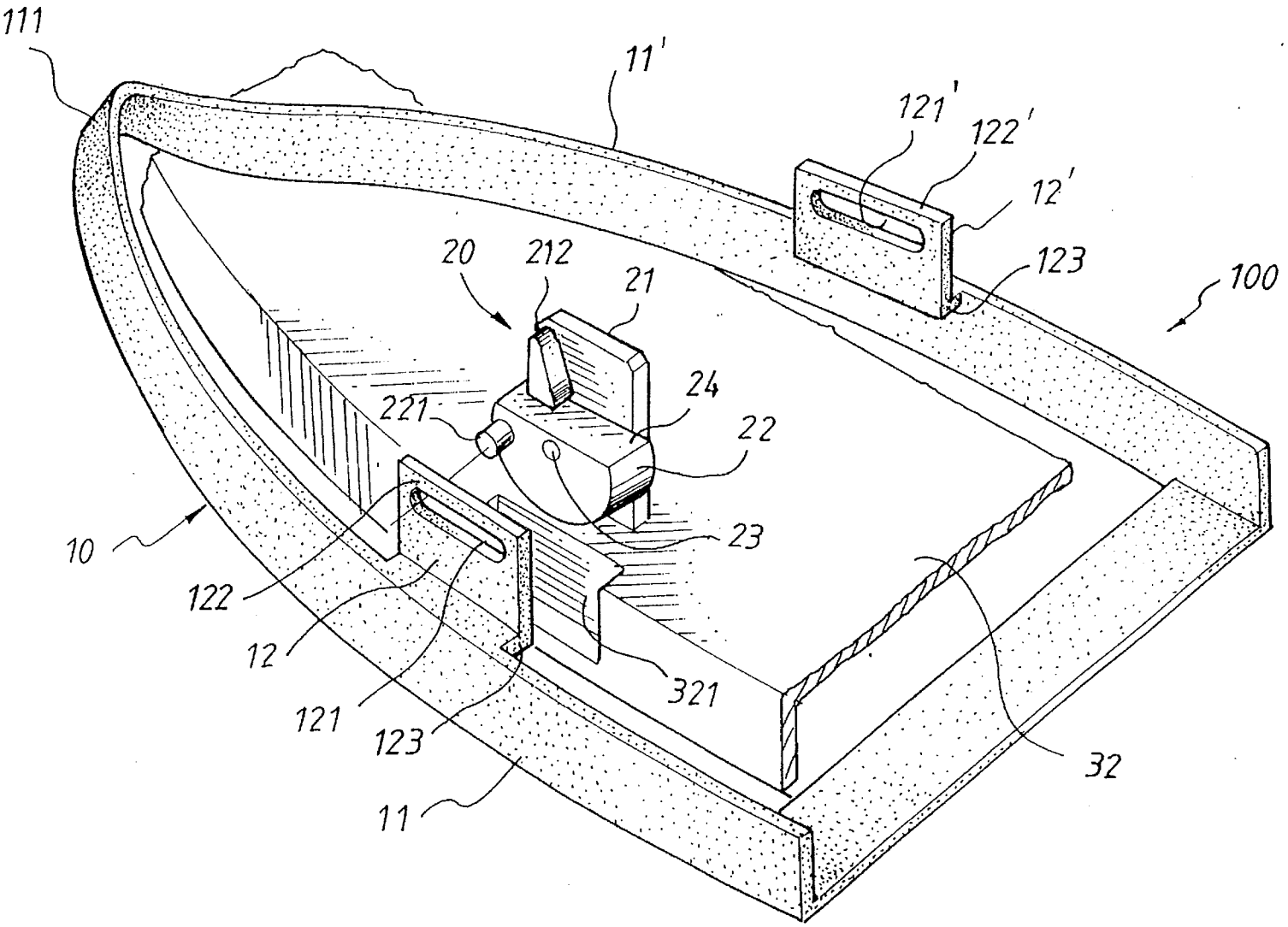
FIG. 4 is an exploded view of the iron in accordance with the present invention, wherein the top part of the iron has been removed to show the structure in accordance with the present invention thereof.

Reference is now made to FIGS. 2, 3 and 4 which depict a burn prevention device 100 for an iron. Traditionally, the iron comprises an iron body 30, a handle 31, a base seat 32, a heating plate 33, a temperature control knob 34. In accordance with the present invention, the burning prevention device 100 comprises a shielding element 10, a first and second displacement member 12, 12' and a first 20 and a second actuating means including a heavy-weighed eccentric block 22 and a positioning plate 21. For the purpose of simplified explanation, only the structure of the first displacement member 12 and the first actuating means 20 is referred to in explanation. The iron has similar structure with that of a conventional iron. In accordance with the present invention, the burning prevention device 100 comprises the shielding element 10, the first actuating device 20, and the first displacement member 12.

The shielding element 10 has a first and a second lateral edge 11, 11' which is made from heat resistance materials, such as plastics, and is configured into the shape of the edge of the heating plate 33. For instance, the shielding element 100 is made to form a slim archshaped member, with a protruded apex 111. The shape and the size of the first and second lateral edge 11, 11' are made to shield the entire external edge of the heating plate 33. The front end of the shielding element 10 is protruded to form a protruded (apex) portion 111 to facilitate the process of ironing.

Referring to FIG. 4, an L-shaped displacement member 12, 12' are individually mounted inwardly onto the first and second lateral edge 11, 11' at the upper center region of the lateral edge 11, 11'. Each of the first and second displacement member 12, 12' has an upper edge 122 and a lower edge 123. A horizontal guiding slot 121, 121', is provided on the displacement members 12, 12' parallel to the upper edge thereof. In order to simplify manufacturing process, the shielding element 10 is formed together with the displacement member 12, 12' as one unit.

The body 30 of the iron is provided with a notch 321 at a position corresponding to the displacement member 12. The notch 321 is provided for the adaptation of the displacement member 12. The displacement member 12 is slidably vertically sitting within the notch 321.

The actuating means 20 comprise a positioning plate 21 perpendicularly mounted onto the base 32, and a heavy-weighed semi-circular eccentric block 22. By the use of an axle 23, the block 22 is rotatably mounted onto the positioning plate 21. The block 22 has a cut-off upper surface 24, and a push rod 221 is provided on the block 22 at a position to fit within the horizontal slot 121 of the displacement member 12, 121; preferably, the push rod 221 is positioned at one corner of the eccentric block 22 close to the protruded portion of the shielding element 10. The axle 23 is substantially mounted at the center of the positioning plate 21, and is adjacent to the upper surface 24 of the semi-circular eccentric block 22. Thus, due to the weight of the eccentric block 22, the eccentric block 22 remains in a downward swing position, where the upper surface 24 faces the top. A push rod 221 is mounted perpendicularly onto the eccentric block 22 such that the push rod 221 is substantially aligned with the axle 23 and is at one corner of the eccentric block 22. A stopping block 212 is mounted onto the positioning plate 21 at a position substantially corresponding to the push rod 221. This stopping block 212 restricts the rotation of the eccentric block 22 about the axle 23 when the iron is held in a vertical position. The other corner opposite to the push rod 221 is blocked by the stopping block 212, and the rotation of the block 22 about the axle 23 is thus restricted.

Figure 5:
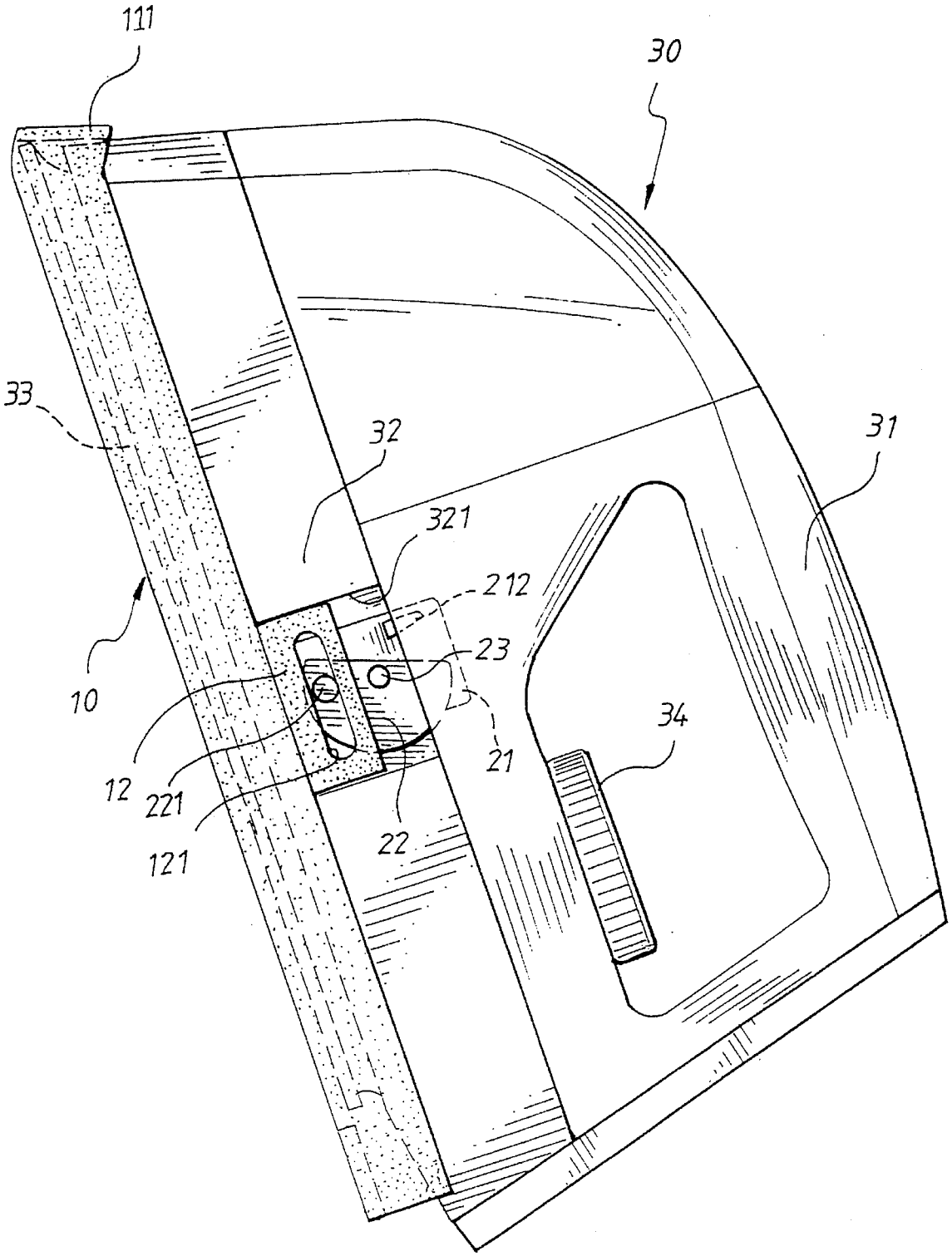
FIG. 5 is an elevational view of the iron in accordance with the present invention, wherein the eccentric block swings downward about the axle to depress the shielding element to encompass the edge of the heating plate of the iron.

Referring to FIGS. 1 and 5–7, the operation of the iron in accordance with the present invention is described below. When the iron is not in use, or temporarily stopped from using, the iron is placed in a vertical position with its end base on a surface or platform. At this position, the eccentric block 22 swings about the axle 23 and stations at a position where the center of gravity of the eccentric block 22 is aligned with the axle 23. The block 22 rotates as a result of the weight of the block 22 moving about the axle 23 and the combined action of the push rod 221 and the guiding slot 121 causes the shielding element 10 to slowly move to cover the outer edge of the heating plate 33, which is shown in FIG. 5.

Figure 6:
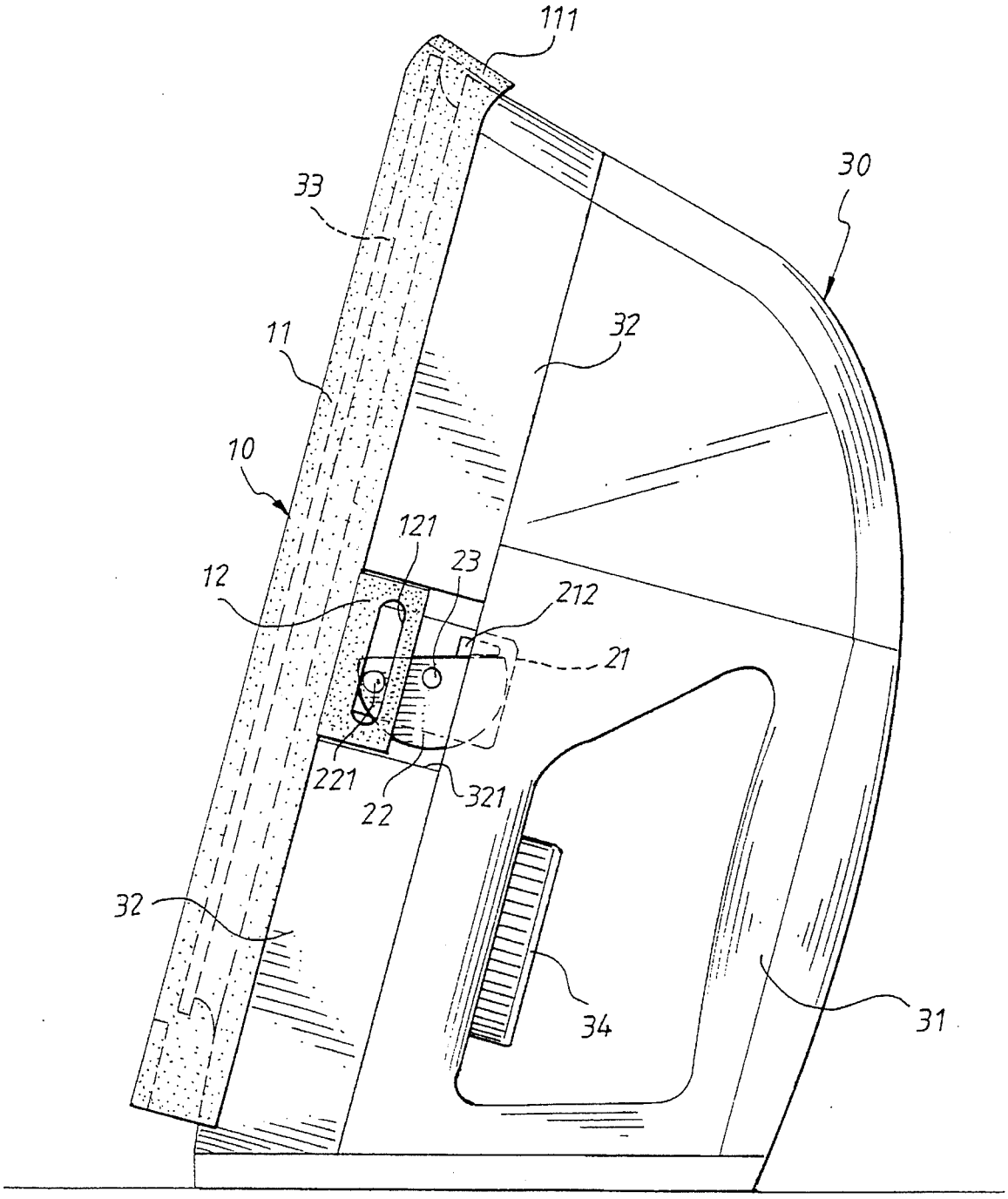
FIG. 6 is an elevational view of the iron in accordance with the present invention, wherein the shielding element has been fully depressed by the eccentric block, and the edge of the heating plate of the iron is thus shielded.
Figure 7:
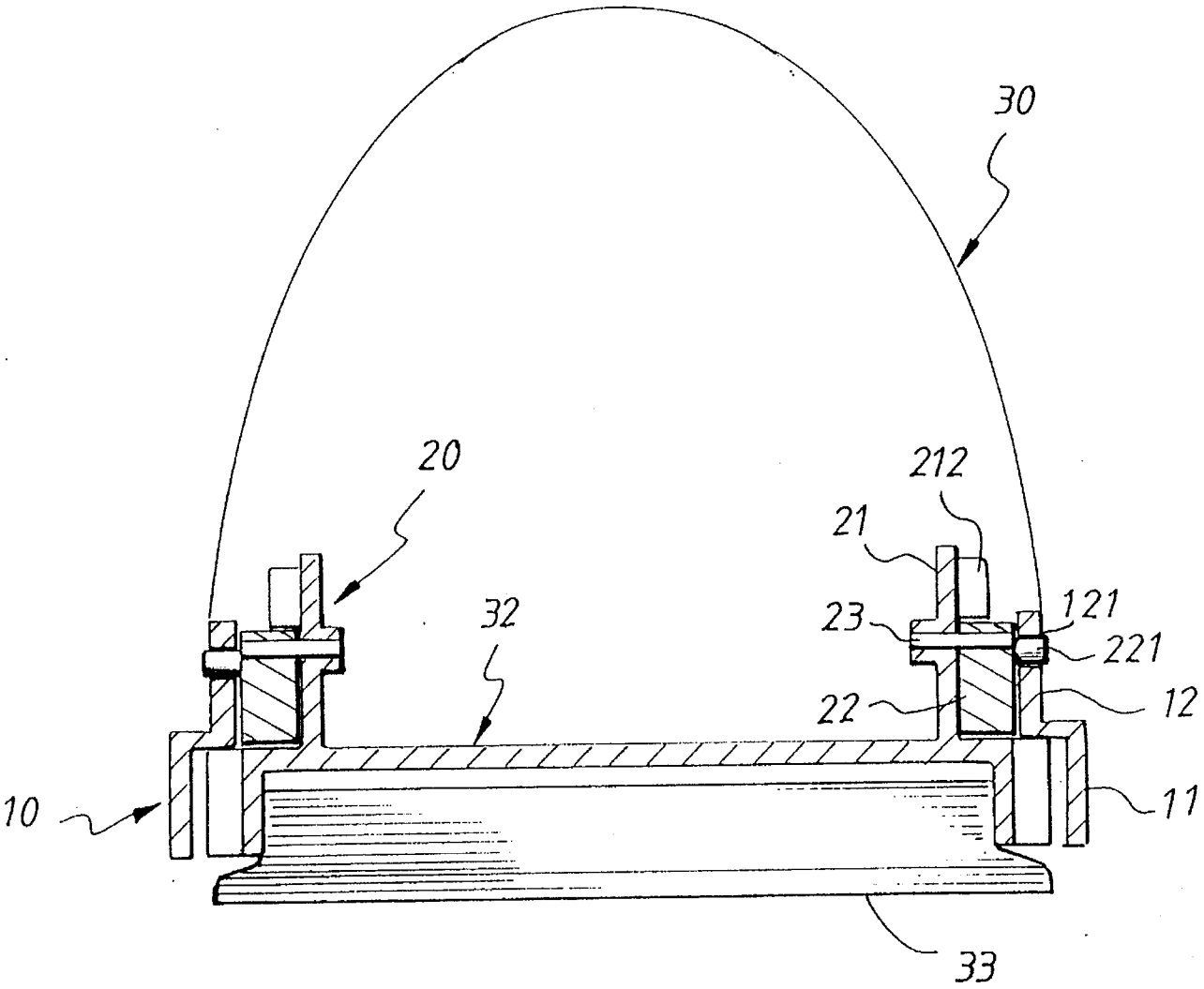
FIG. 7 is a sectional view along line 7—7 of FIG. 3 in accordance with the present invention, showing the retraction of the shielding element to its original position.

After the iron is placed in a vertical position, one corner (the corner opposite to the push rod 221) of the eccentric block 22 is exactly blocked by the stopping block 212. At this instance, even if the shielding element 10 is accidentally knocked or impacted by an external article, the shielding element will not retract back into its original position, which is shown in FIG. 6.

The shielding element 10 provides a protection to the user to prevent the accidental contact with the external edge of the heating plate 33. When the iron is used to iron clothes, the iron is placed horizontally with the heating plate 33 facing downward. The eccentric block 22 returns or restores to its original position which is shown by the dotted lines in FIG. 3, and the shielding element 10 moves back to a position above the edge of the heating plate 33 by means of the urging of the rotation caused by the eccentric block 22.

In the preferred embodiment in accordance with the present invention, the first and second displacement member 12, 12' is mounted individually at the first and second protective edge 11, 11' of the body of the iron respectively. A notch 321' and a second actuating means 3' are individually mounted at the body of the iron similar to that explained above as a preferred embodiment to shield the edge of the heating plate 33. Thus, the movement of the shielding element 10, under the first and second actuating means 3, 3', is smooth in operation.

Preferred embodiment has been disclosed. A person of ordinary skill in the art would realize, however, that certain modifications would come within the teaching of this invention. For instance, it may be desirable to design a different shaped eccentric block and to mount the block at a different position on the body of the iron. However, the following claims should be studied in order to determine the true scope and content of the invention.

We claim:

1. A burn prevention device for an iron having a heating plate and a body, comprising:

a) a shielding element, having a first and second lateral edge, being formed into an archshaped framework adaptable onto the external edge of the heating plate;

b) a first displacement member having an upper and lower edge, and having a horizontal slot parallel to the upper edge thereof, the lower edge thereof being mounted substantially at the center and at the upper edge of said first lateral edge;

c) a second displacement member having an upper and lower edge, and having a horizontal slot parallel to the upper edge thereof, the lower edge thereof being mounted at the center of said second lateral edge;

(d an actuating device including a heavy weight semi-circular eccentric block having a cut-off upper surface, front and rear ends; a positioning plate and a push rod being mounted at a position on the block so as to fit within the horizontal slot of the displacement member, said eccentric block being rotatably mounted by an axle onto the positioning plate which is perpendicularly mounted to the body of the iron;

whereby, when the iron is placed in a vertical position, the actuating device causing the eccentric block to urge the shielding element to cover the edge of the heating plate.

2. A burn prevention device as set forth in claim 1, wherein the eccentric block is a rotatable heavy weight mounted onto the positioning plate of the iron.

3. A burn prevention device as set forth in claim 1, wherein the push rod is slidable within the horizontal guiding slot.

4. A burn prevention device for an iron having a heating plate and a body, comprising:

a) a shielding element, having a first and second lateral edge, being formed into an arch-shaped framework adaptable onto the external edge of the heating plate;

b) a first displacement member having an upper and lower edge, and having a horizontal slot parallel to the upper edge thereof, the lower edge thereof being mounted substantially at the center and at the upper edge of said first lateral edge;

c) a second displacement member having an upper and lower edge, and having a horizontal slot parallel to the upper edge thereof, the lower edge thereof being mounted at the center of said second lateral edge;

d) an actuating device including a heavy weight semi-circular eccentric block having a cut-off upper surface, front and rear ends, a positioning plate and a push rod being mounted at a position on the block so as to fit within the horizontal slot of the displacement member; said rotatable eccentric block being mounted by an axle onto the positioning plate which is perpendicularly mounted to the body of the iron; and e) a stopping block being mounted onto the positioning plate, adjacent to the upper surface of said block and being substantially beyond the pushing rod;

whereby, when the iron is placed in a vertical position, the actuating device causing the eccentric block to urge the shielding element to cover the edge of the heating and the rear end of said eccentric block being stopped by said stopping block.

5. A burn prevention device as set forth in claim 4 wherein the eccentric block is a heavy weight rotatably mounted onto the positioning plate of the body.

6. A burning prevention device as set forth in claim 4, wherein the push rod is slidable within the horizontal guiding slot.

* * * * *